United States Patent [19]

Heyman et al.

[11] Patent Number: 4,729,138

[45] Date of Patent: Mar. 8, 1988

[54] UTILITY CLAMP

[76] Inventors: Arnold M. Heyman, 2701 W. Alameda Ave., Suite 406, Burbank, Calif. 91505; Pradip V. Choksi, 18717 Parthenia St., Unit 6, Northridge, Calif. 91324

[21] Appl. No.: 932,465

[22] Filed: Nov. 18, 1986

[51] Int. Cl.[4] ..... A47C 27/03; A44B 21/00; F24N 9/06

[52] U.S. Cl. ..... 5/508; 5/503; 5/424; 24/335; 248/231.7

[58] Field of Search ..... 5/424, 498, 503, 508; 24/316, 328, 335, 343, 486; 128/134; 248/231.7

[56] References Cited

U.S. PATENT DOCUMENTS

| | | | |
|---|---|---|---|
| 684,866 | 10/1901 | Ringdahl | 5/498 X |
| 759,560 | 5/1904 | Sharp | 248/231.7 X |
| 807,706 | 12/1905 | Allen | 5/498 X |
| 1,860,874 | 3/1932 | Triplett . | |
| 2,265,507 | 12/1941 | Anderson et al. | 24/316 |
| 2,607,401 | 8/1952 | Pruyne | 5/503 |
| 2,679,842 | 6/1954 | Brill . | |
| 2,689,995 | 9/1954 | Smith | 24/335 X |
| 2,968,077 | 1/1961 | Miller et al. | 24/328 |
| 3,981,492 | 9/1976 | Hallmann . | |
| 4,145,082 | 3/1979 | Daly et al. . | |

*Primary Examiner*—Alexander Grosz
*Assistant Examiner*—Michael F. Trettel
*Attorney, Agent, or Firm*—Spensley Horn Jubas & Lubitz

[57] ABSTRACT

An adjustable utility clamp device easily attachable to a hospital bed frame, standard bed frame tubular frame member or other frame member allowing for easy securance and release of limb restraint straps or other devices and having no protruding edges and the adjustment means being inaccessible to the restrained patient.

16 Claims, 15 Drawing Figures

UTILITY CLAMP

BACKGROUND OF THE INVENTION

1. Field of the Invention

Standard hospital beds or other framed devices often have no device for attachment of limb restraint straps, body restraint jackets, urinary drainage bags, etc. The object of the present invention is to provide a simple utility clamp for hospital or home usage which may be inexpensively formed and easily attached to hospital bed frames, wheelchairs, gurneys and other frames of any cross-sectional shape and adjustable and attachable along the frames at any point to allow easy securance of limb restraint straps, etc. in a safe and easily usable manner.

2. Description of the Prior Art

The prior art has a number of restraint apparatuses for hospital beds, none of which contain all the features of the present invention. In some cases specially constructed beds are provided with holding means, the special construction being such that it is expensive to produce and in some cases difficult to operate. Other devices have been attached to the bed frame allowing for securance of limb restraints. These often have been inconvenient, not allowing for easy positioning of the device along the bed frame unless the patient is removed and the bed mattress is lifted. Additionally, threading the limb restraint has been difficult for this same reason. Some have also been accessible to the patient allowing loosening of the clamping mechanism. Moreover, these devices have had dangerously protruding edges. Further, the straps are not easily removable. These devices have also had problems with remaining secure as tugging on the restraints can cause a torque which loosens the device.

SUMMARY OF THE INVENTION

The device of the instant invention can be attached to frames of any cross-sectional shape for a multitude of uses. Representative are standard hospital beds. Hospital beds as well as standard beds are composed of angle member frames. Standard wheelchairs and gurneys often have tubular frames. The instant invention utility clamp is designed to attach to these frames securely, and adjust to them by means of a bolt member which attaches to the bed frame angle or tubular frames. The utility clamp for hospital beds is so proportioned so as to be adjustable along the entire hospital bed frame which is broken up into several pieces to allow adjustment of the bed. Similarly, on regular bed frames and tubular frames of wheelchairs and gurneys, the utility clamp is adjustable along the entire frame. The securing means are situated on the backside of the utility clamp for hospital beds and standard beds so that the grip presents a smooth surface for incidental contact by legs or arms. The securing means are thus also unavailable to the restrained patient. Further, the utility clamp for hospital beds and standard beds is curved inward and has rounded exterior corners to prevent injurious incidental contact. The utility clamp for hospital beds has a single slot positioned to allow easy securance of restraint straps and being slanted so as to prevent the patient from pulling a strap loose, but being easily releasable by anyone else by means of a release mechanism composed of a lever and cam. The utility clamp also provides for attachment of urinary drainage bags. The utility clamp for standard bed frames also has a single slot allowing easy securance of standard restraint straps. Either device may have other securance means including a double slot design. The utility clamp for wheelchair frames and other tubular frames is provided with securing means on the under backside to allow easy attachment and provide a smooth surface for incidental contact by legs or arms. The utility clamp for tubular members can have a cam and pin or double slots, allowing easy securance of standard restraint straps. Other versions of the utility clamp are possible and can be provided double slots, slots, hooks or other means for securance of desired devices. Each version of the utility clamp can be inexpensively manufactured out of aluminum, plastic or other suitable materials.

Moreover, the present invention allows for speedy and easy removal of any restraints in case of fire or other emergency. See e.g. California Health Facilities and Referral Agencies Regulations §72319(h). The single slot and double slot versions have specific instructions for securance of restraint straps and thus provide easy release of the straps in case of emergency.

DESCRIPTION OF THE PREFERRED EMBODIMENT

Figure 1:
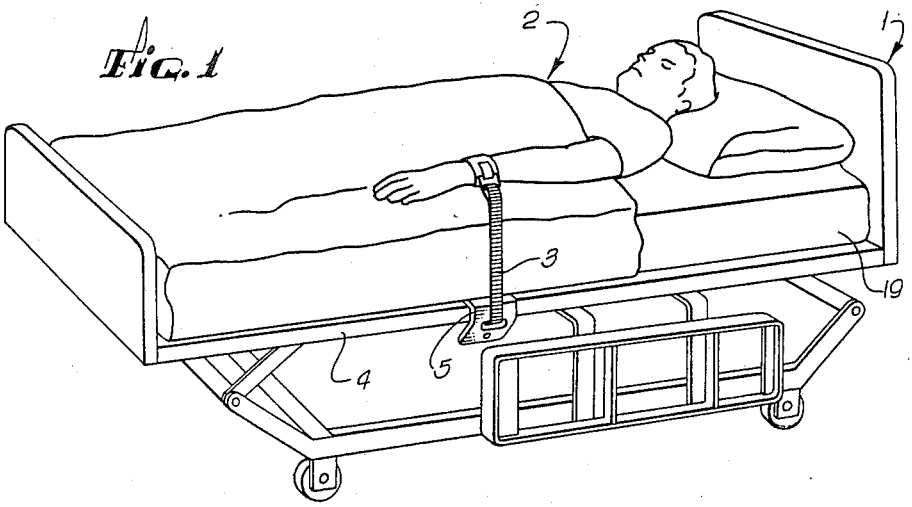
FIG. 1 is a perspective view showing a hospital bed with a patient thereon and restraint straps connected to one of the utility clamps of this invention.
Figure 3:
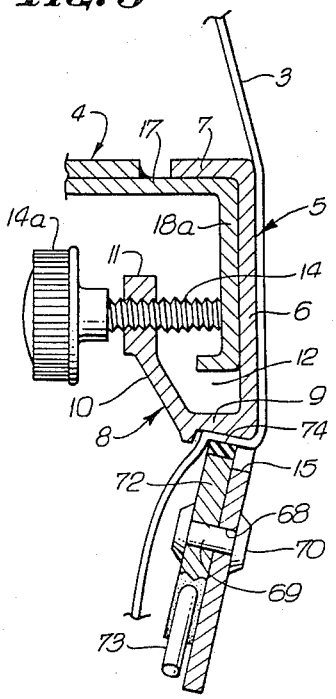
FIG. 3 is a sectional view of FIG. 2 showing the utility clamp attached to the bed frame.
Figure 4:
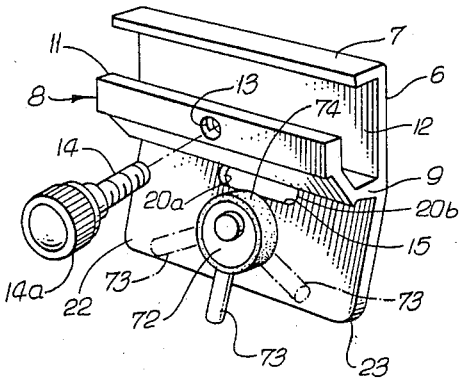
FIG. 4 is a perspective view of the utility clamp from the back securing side of the device.

FIG. 1 shows a hospital bed 1 with a patient 2 lying thereon and secured thereto with a strap 3. The strap 3 is secured to a bed frame 4 by means of the present invention, a bed utility clamp 5. The utility clamp 5 as shown in detail in FIGS. 3 and 4 is composed of a plate 6 having integrally connected to it at roughly right angles a top plate 7 and a bottom member 8. The plate 6 is bent inward at point slightly below the point of connection with the bottom member 8. The bottom member 8 is composed of integrally connected rectangular members, 9, 10 and 11. Rectangular member 11 is parallel to the plate 6, forming a channel 12 between the two.

Rectangular member 11 has a threaded bore 13 in which is disposed a bolt 14 or some other easily hand-turned threaded member. The bolt has a large head member 14*a* allowing easy tightening or loosening of the bolt 14. The plate 6 has a single slot 15 located just below the point of connection of the bottom member 8 to the plate 6, and in the inwardly bent section of the plate 6 through which a strap 3 or similar device may be secured (see FIG. 2). The plate 6 has an aperture 68 located below the slot 15. A pin 69 is disposed in the aperture 68 which can freely rotate in the aperture 68. The pin 69 has a head 70 extending beyond the aperture 68 on the exposed side of the plate 6. The head 70 of the pin 69 is of greater diameter than the aperture 68 to retain the pin in the aperture 68. The head 70 has a smooth outer surface. The other end of the pin 69 is connected to a cam 72. The cam 72 has break machined edges 74 so as not to cause damage to the strap 3. The cam 72 has a lever 73 integrally connected to it to allow rotation of the cam 72 about an axis defined by the pin 69. An attendant can easily tighten or release the strap for any reason by turning the lever 73. A single slot without the cam and lever may be provided to allow alternative means of securing restraint straps by means such as a hook and loop type fastener sold under the trademark VELCRO (see FIGS. 8 and 9). Alternatively a double slot formation may be used to secure limb restraint straps (see FIGS. 5–7).

The bottom corners of the plate 22 and 23 are rounded. The inward surface 24 may have a curved ledge 25 located at the bottom of the plate 6 to allow a urinary drainage system 26 to be attached by means of a string 27 which is common in such a device. (See FIGS. 9 and 11).

Figure 2:
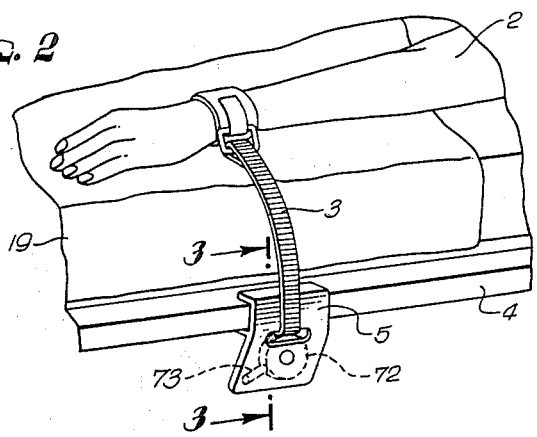
FIG. 2 is a close-up perspective view of the utility clamp having a restraint strap secured thereto.

In use, the utility clamp 5 is attached to a bed frame 4 as shown in FIGS. 2 and 3. The top plate 7 sits on the top surface 17 of the bed frame angle 18 of the bed frame 4. Bottom member 8 fits around the bottom member 18*a* of the bed frame angle 18. The bottom member 18*a* is partially disposed in the channel 12 between plate 6 and rectangular member 11. The bolt 14 is tightened securely by means of the head member 14*a* gripping the bottom member 18*a* of the bed frame angle 17. The strap 3 may then be secured on the utility clamp 5 through slot 15 after it has been attached to the limbs of the patient. The lever 73 is then rotated to cause the break edges of the cam to frictionally engage the strap 3 between the cam 72 and rectangular member 9 of the bottom member 8. The utility clamp 5 may also be used to secure other devices besides restraining straps such as securing urinary drainage bags 26 and restraint vests 28. (See FIGS. 5–11 which depict alternative embodiments of the invention.

The utility clamp 5 may be easily adjusted along the length of the bed frame 4 by merely loosening the bolt 14 by means of the head member 14*a*, repositioning the utility clamp 5 along the bed frame 4 and then securing it to the bottom web member 18*a* of the bed frame angle 17 at the desired position. (See FIG. 2.) The patient 2 nor the mattress 19 need not be disturbed. The utility clamp 5 is of sufficiently narrow width to allow its securance to practically anywhere along the bed frame 4 which is typically composed of various length angle members in a hospital bed to allow positioning of the bed. (See FIG. 2.)

The utility clamp 5 is adjustable to various size bed frame members and is easily secured by means of the bolt 14. The corners 20*a* and 20*b* are rounded on the bed utility clamp 5 so as to avoid sharp edges which may sever or cut into the strap 3. Additionally, for this reason, the bolt 14 is secured to the backside of the bed frame so as to avoid interfering with the strap 3. Further, the bolt 14 is so located to prevent a restrained patient from loosening the bolt 14 of the utility clamp 5 or an attendant from scraping a leg against the bolt. Similarly to prevent injury to a nurse or others around the bed, the plate 6 is curved inward toward the bed, and has rounded corners 22 and 23 and has the extending bolt 14 located on the inward side of bed utility clamp. (FIG. 4.) Moreover, the head 70 of the pin 69 is smooth and does not have any sharp edges.

Figure 5:
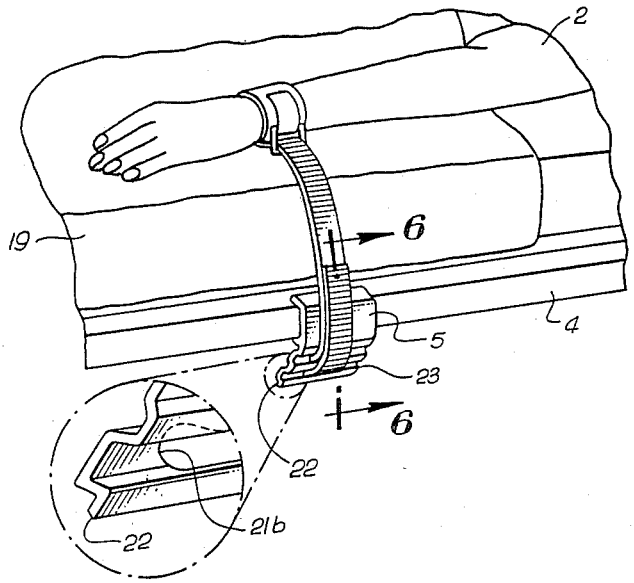
FIG. 5 is a close-up perspective view of the utility clamp having a restraint strap secured therto.
Figure 6:
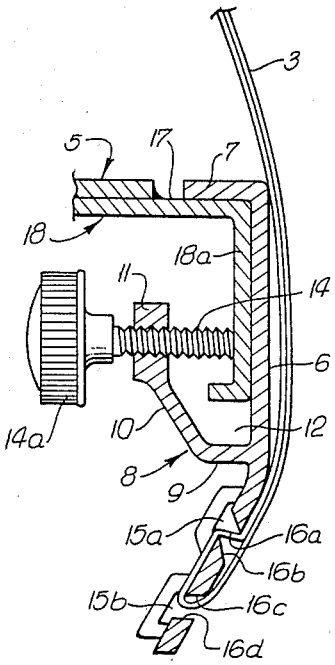
FIG. 6 is a sectional view of FIG. 5 showing the utility clamp attached to the bed frame.
Figure 7:
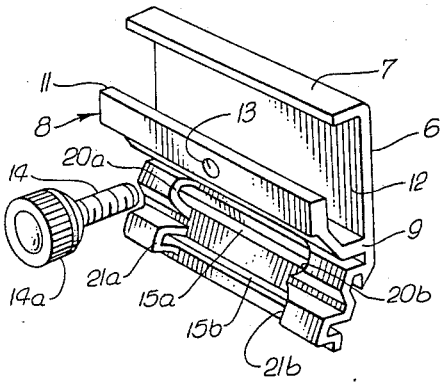
FIG. 7 is a perspective view of the utility clamp from the back securing side of the device.

Instead of a single slot and cam mechanism, the utility clamp 5 may have double slots 15*a* and 15*b* as shown in FIGS. 5–7. In the double slot device, the slots 15*a* and 15*b* are cut in the plate 6 at angles which make the slots nonparallel to one another. Such nonparallel alignment of the slots 15*a* and 15*b* permits loosening of the strap in only one direction. The edges 16*a*, 16*b*, 16*c* and 16*d* of the slots 15*a* and 15*b* then prevent the restrained patient from releasing the straps since the patient cannot pull down on the strap loosening it. Contrarily, an attendant can easily release the strap for any reason by pulling down on it. The slots 15*a* and 15*b* have rounded corners 20*a*, 20*b*, 21*a* and 21*b* to prevent damage to the strap.

Figure 12:
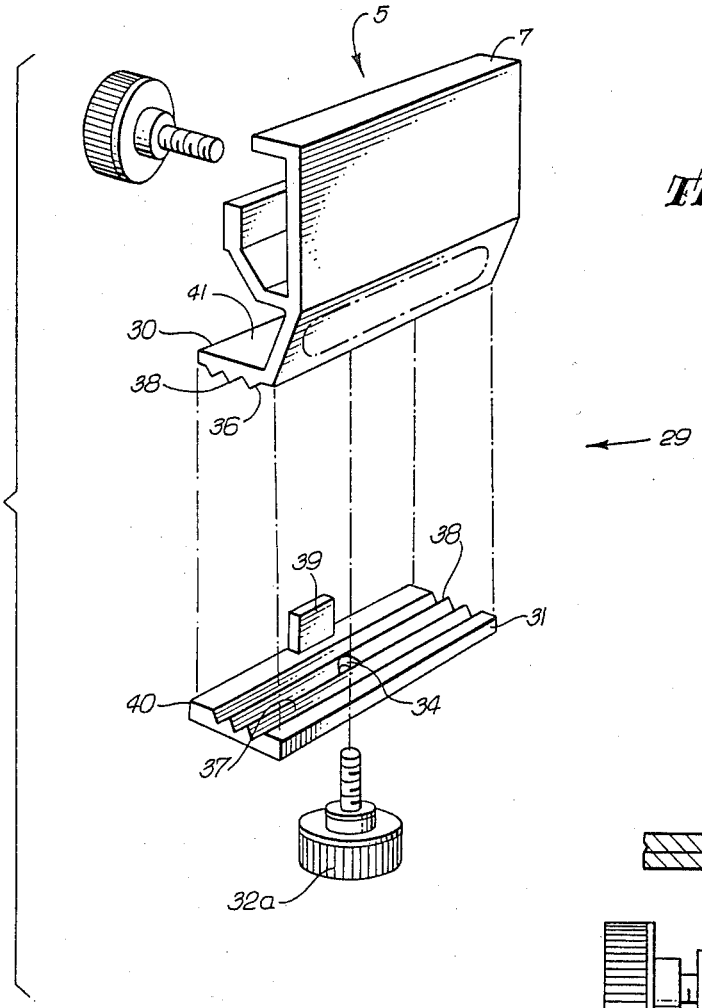
FIG. 12 is a perspective view of the utility clamp having a clamp mechanism for securance of restraint straps.
Figure 13:
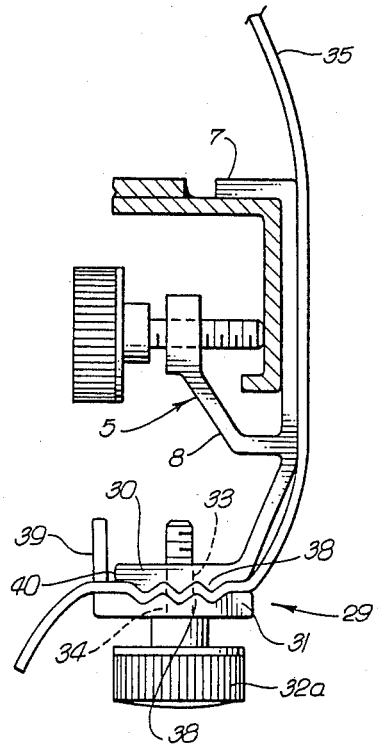
FIG. 13 is a sectional view of the utility clamp having a clamp mechanism for securance of restraint straps.

In lieu of slots, the utility clamp 5 may have a clamp mechanism 29 for securance of restraint straps and restraint vests (see FIGS. 12 and 13). The clamp mechanism has a first plate 30 integrally connected to the plate 6 at the bottom of plate 6. This first plate 30 is roughly parallel to the top plate 7 at opposite ends of plate 6. The first plate 30 is connected to the second plate 31 by means of a bolt 32. This bolt 32 may be positioned through aligned bores 33 and 34 in plates 30 and 31 respectively. By so securing the bolt 32 the first plate 30 and second plate 31 form jaws for clamping a restraint strap 35. To allow for increased clamping strength, the engaging surface 36 of the first plate 30 and the engaging surface 37 of the second plate 31 have matching teeth 38 (see FIGS. 12 and 13). The second plate 31 has a post member 39 positioned roughly at a right angle to the second plate 31. The post member 39 is positioned on the inner edge 40 of the second plate at roughly its center. When the second plate 31 is secured to the top plate 30 by means of the bolt 32, the post member 39 extends vertically beyond the top surface 41 of the first plate 30.

In use, this version of the utility clamp 5 is secured to the bed frame in the usual manner as before described. The restraint strap 35 is secured to the utility clamp 5 by unscrewing the bolt 32 by digitally turning the bolt head 32*a*. The restraint strap 35 is then placed across the engaging surface 37 of the second plate 31. The first plate 30 is then aligned with the second plate 31 and the bolt 32 is screwed into the bore 33 tightly securing the engaging surfaces 36 and 37 of the first plate 30 and second plate 31. The clamping mechanism 29 thus securely holds the restraint strap 35. The position of the bolt 32 makes it unavailable to the restrained patient. The restraint strap can easily be removed by an attendant.

Figure 8:
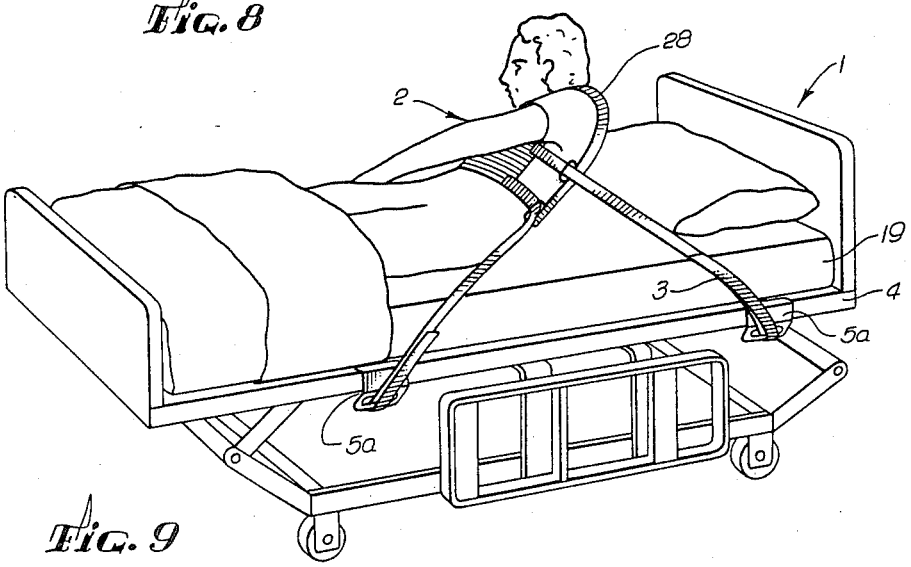
FIG. 8 is a perspective view showing a hospital bed with a patient thereon secured in a restraint vest connected to an alternative embodiment of the utility clamp of this invention.
Figure 9:
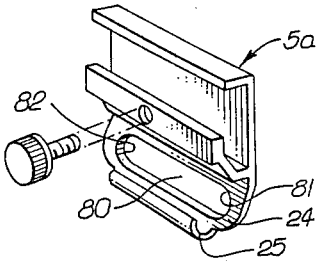
FIG. 9 is a perspective view of an alternative embodiment of the utility clamp from the back side of the device.
Figure 11:
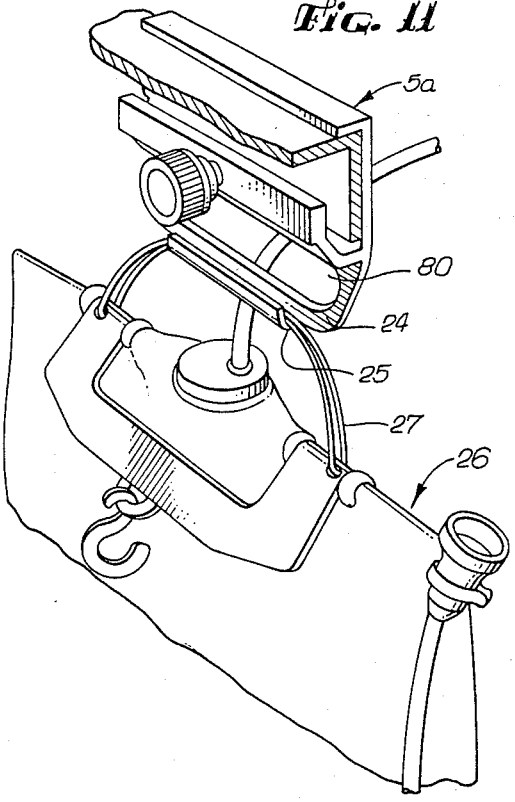
FIG. 11 is a perspective view of an alternative embodiment of the utility clamp from the back showing a urinary drainage system connected to the utility clamp of this invention.

An alternative embodiment of the device, 5*a*, which provides many of the same benefits as aboved described is shown in FIGS. 8, 9 and 11. This version of the utility clamp has a single slot 80. This slot has rounded corners 81 and 82 to prevent damage to restraint straps. Restraint straps which attach by means of velcro or other means may be attachable to the single slot. Additionally, a urinary drainage bag may be attached to the single slot device.

Figure 10:
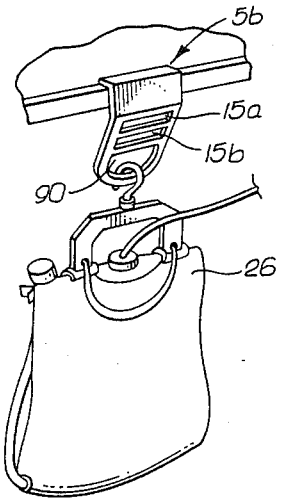
FIG. 10 is a perspective view showing a urinary drainage system connected to the utility clamp of this invention.

A further alternative embodiment of the device 5*b* shown in FIG. 10 combines features of other embodiment. This device has 3 slots, 15*a*, 15*b*, and 90. The slots can be used for securance of restraint straps or the slot 90 can be used for securing a urinary drainage bag 26 or other devices.

Figure 14:
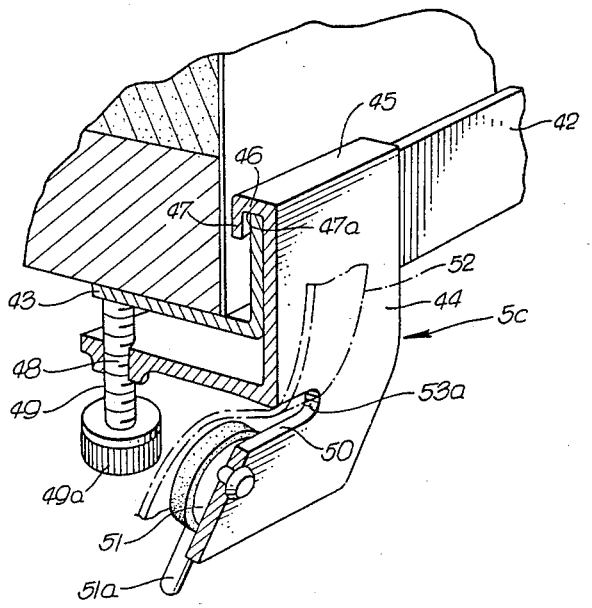
FIG. 14 is a sectional view of the utility clamp having a single slot and cam mechanism for securance of restraint straps attached to a standard bed frame.

Another alternative embodiment of the device which provides the same benefits as above described is shown in FIG. 14. This version of the utility clamp, 5*c*, attaches to a standard bed frame 42. The angle 43 of a standard bed frame is inverted from that of a hospital bed frame 17 (see FIG. 3 for comparison). This utility clamp 5*c* is composed of a plate 44 integrally connected roughly at right angles to a top member 45 and a bottom plate 45*a*. The plate 44 is bent inward at a point slightly below the point of connection with the bottom plate 45*a*. The top member has two integrally connected rectangular members 46 and 47. The first member 46 is attached at roughly a right angle to the plate 44. The second member 47 is attached integrally to the first member 46 and at roughly a right angle forming a channel 47*a* between it and the plate 44. The bottom plate 45*a* has a threaded bore 48 in which is disposed a bolt 49 or some other easily handturned threaded member. The bolt 49 has a large head member 49*a* allowing easy tightening or loosening of the bolt 49. The bottom plate 45*a* is of greater thickness at the bore 48 to allow a secure bolt-bore fit.

The plate 44 has a slot 50 and a cam 51 with a lever 51*a* located below the point of connection of the bottom plate 45*a* to the plate 44, and in the inwardly bent section of the plate 44 through which a strap 52 or similar device may be secured (see FIG. 14). This cam and lever work in the same way as those in the preferred embodiments (see FIGS. 1–4 and description.) Alternatively a double slot or other securing mechanism may be used.

In use, the utility clamp 5*c* is attached to the bed frame in substantially the same way as the first embodiment. The strap 52 may be secured through the slot 50 and secured by the cam 51. The corners 53*a* and 53*b* (only 53*a* is shown) of the slot 50 are rounded so as to avoid interfering with the strap 52.

Figure 15:
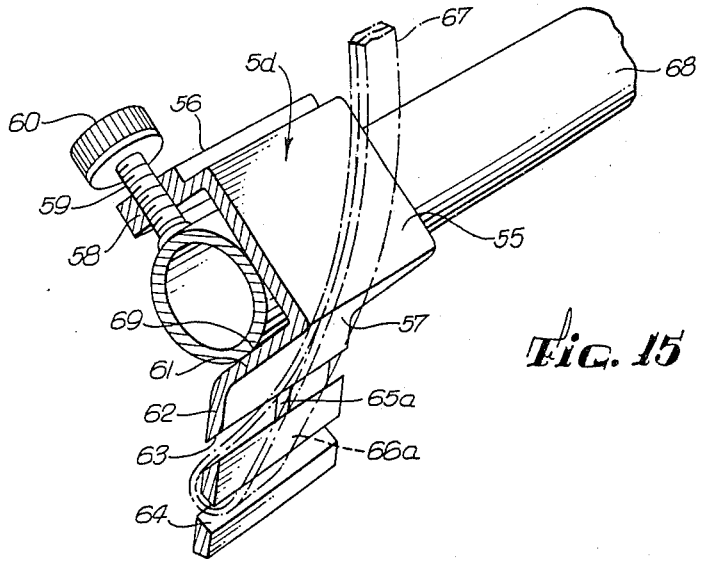
FIG. 15 is a sectional view of the utility clamp having double slots for securance of restraint straps attached to a tubular frame.

Another embodiment of the utility clamp, 5*d*, which provides the same benefits as above described is shown in FIG. 15. This version of the utility clamp 5*d* attaches to tubular frame members such as found in wheelchairs.

The utility clamp for tubular frame members is composed of a plate 55 having integrally connected to it roughly at right angles a top member 56 and a bottom member 57. The top member has a threaded bore 58 in which is disposed a threaded member 59 having a head member 60. The top member 56 is of greater thickness at the bore 58 to allow a secure bolt-bore fit.

The bottom member 57 has two roughly rectangular sections 61 and 62. The first rectangular section 61 is connected to the plate 55. The second rectangular section 62 is connected at an angle to first rectangular section 61. In this second rectangular section 62 are disposed two slots 63 and 64 having rounded corners 65*a* and *b* and 66*a* and *b* (only 65*a* and 66*a* are shown). These slots are non parallelly aligned as in the embodiment shown in FIGS. 5–8 so a strap 67 can be easily secured. Alternatively, a single slot and cam mechanism or other strap securing device can be used.

In use the bed utility clamp 5*d* is attached to a tubular frame 68 as shown in FIG. 15. The bottom member 57 has an inner surface 69 on which sits on the tubular frame 68. The bolt 59 is tightened securely gripping the tubular frame 68 between the bolt 59 and the bottom member 57. The strap 67 may then be secured on the utility clamp 5*d* through slots 63 and 64. The utility clamp may be used to secure other devices besides restraint straps and is easily adjusted along the length of the tubular frame due to its narrow width.

The utility clamp 5*d* is adjustable to various diameter tubular members and is easily secured by means of the bolt 59. The bolt is situated so as not to interfere with the strap 67. Moreover, it is inaccessible to the patient. The utility clamp 5*d* is also designed to point inward so as to avoid any incidental contact with the bolt 59 or other sharp edges by an attendant's legs or arms. Further, the double slot design allows for easy release of the restraint strap 67 for any reason including emergencies.

I claim:

1. A utility clamp comprising:

(1) a first member having a top and a bottom and an outside and an inside, the outside being completely flush;

(2) a second member attached at the top of the first member, the second member not projecting beyond the outside of the first member;

(3) means for clamping the utility clamp to a support frame;

(4) means for attachment of straps or hooks or similar elements to the first member the attachment means not projecting beyond the outside of the first member the means for attachment of straps comprising a single slot and cam mechanism.

2. A utility clamp, comprising:

(1) a first member having a top and a bottom and an outside and an inside, the outside being completely flush;

(2) a second member attached at the top of the first member, the second member not projecting beyond the outside of the first member;

(3) means for clamping the utility clamp to a support frame;

(4) means for attachment of straps or hooks or similar elements to the first member the attachment means not projecting beyond the outside of the first member said first means comprising double slots which are angled and nonparallel to each other and thus provide for loosening of the straps if pulled in one direction and no movement of the straps if pulled in another direction.

3. The utility clamp of claim 2, wherein the first member has rounded corners at the bottom.

4. The utility clamp of claim 2, further comprising means for attachment of a string to a urinary bag.

5. A utility clamp comprising:

a first member having a first generally planar section and a second section integral to the first section and forming an oblique angle thereto;

a second member integral to the first section of the first member and generally perpendicular thereto;

a third member integral to the first section of the first member, the third member having a first section generally perpendicular to the first section of the first member and a second section generally parallel to the first section of the first member, said second section having a bore; and a bolt disposed in the bore and adapted to secure the utility clamp to a frame.

6. The utility clamp of claim 5 wherein the second section of the first member defines a slot.

7. The utility clamp of claim 6 further comprising a cam action clamping means for clamping a strap extending through the slot.

8. The utility clamp of claim 7 wherein the cam action clamping means comprises a cam rotatably mounted on the second section of the first member and including a lever means for rotating said cam.

9. The utility clamp of claim 5 wherein the second section of the first member defines two angular, non-parallel slots.

10. The utility clamp of claim 5 further comprising a clamping mechanism comprising a first plate integrally attached to the second section of the first member and generally parallel to the second member and a second plate adapted to be releasably joined in a clamping fashion to the first plate.

11. The utility clamp of claim 10 wherein the first and second plates define bore holes and the first and second plates are joined together in a clamping fashion by bolting said plates together.

12. The utility clamp of claim 5 further comprising hook means for attachment of a urinary bag to said utility clamp.

13. A utility clamp comprising:

a first member having a first generally planar section and a second section integral to the first section and forming an oblique angle thereto;

a second member integral to the first section of the first member, the second member having a first section generally perpendicular to the first section of the first member and a second section generally parallel to the first section of the first member;

a third member integral to the first section of the first member and generally perpendicular thereto said third member having a bore;

a bolt disposed in the bore and adapted to secure the utility clamp to a frame; and a cam action clamping means comprising a cam rotatably mounted on the second section of the first member and including a lever means for rotating said cam.

14. A utility clamp comprising:

a first member having a first generally planar section and a second section integral to the first section and forming an oblique angle thereto;

a second member integral to the first section of the first member, the second member having a first section generally perpendicular to the first section of the first member and a second section generally parallel to the first section of the first member;

a third member integral to the first section of the first member and generally perpendicular thereto said third member having a bore;

a bolt disposed in the bore and adapted to secure the utility clamp to a frame; and attachment means for attachment of restraining straps the attachment means comprising two angular non-parallel slots located in the second section of the first member.

15. A utility clamp for attachment to a tubular support comprising:

a first member having a top and a bottom;

a second member integrally attached to the top of the first member and being generally perpendicular thereto the second member defining a bore;

a third member having a first and second section the first section being integrally attached to the bottom of the first member and being generally perpendicular thereto the second section being integral to the first section and forming an oblique angle thereto; and a cam action clamping means comprising a cam rotatably mounted on the second section of the third member and including a lever means for rotating said cam.

16. A utility clamp for attachment to a tubular support comprising:

a first member having a top and a bottom;

a second member integrally attached to the top of the first member and being generally perpendicular thereto the second member defining a bore;

a third member having a first and second section the first section being integrally attached to the bottom of the first member and being generally perpendicular thereto the second section being integral to the first section and forming an oblique angle thereto; and attachment means for attachment of restraining straps the attachment means comprising two angular, non-parallel slots located in the second section of the third member.

* * * * *